US011905862B2

(12) United States Patent
Weber et al.

(10) Patent No.: US 11,905,862 B2
(45) Date of Patent: Feb. 20, 2024

(54) GEAR DEVICE, CAMSHAFT ADJUSTER HAVING THE GEAR DEVICE, AND INTERNAL COMBUSTION ENGINE

(71) Applicant: Schaeffler Technologies AG & Co. KG, Herzogenaurach (DE)

(72) Inventors: Juergen Weber, Erlangen (DE); Rainer Ottersbach, Aurachtal (DE); Resat Aras, Fürth (DE)

(73) Assignee: Schaeffler Technologies AG & CO. KG, Herzogenaurach (DE)

( * ) Notice: Subject to any disclaimer, the term of this patent is extended or adjusted under 35 U.S.C. 154(b) by 0 days.

(21) Appl. No.: 18/016,113

(22) PCT Filed: Jul. 22, 2021

(86) PCT No.: PCT/DE2021/100635
§ 371 (c)(1),
(2) Date: Feb. 17, 2023

(87) PCT Pub. No.: WO2022/022772
PCT Pub. Date: Feb. 3, 2022

(65) Prior Publication Data

US 2023/0272727 A1 Aug. 31, 2023

(30) Foreign Application Priority Data

Jul. 27, 2020 (DE) ..... 10 2020 119 695.4

(51) Int. Cl.
*F01L 1/352* (2006.01)
*F01L 1/46* (2006.01)
*F01L 13/00* (2006.01)

(52) U.S. Cl.
CPC ..... *F01L 1/352* (2013.01); *F01L 1/46* (2013.01); *F01L 2001/3521* (2013.01); *F01L 2013/103* (2013.01); *F01L 2820/032* (2013.01)

(58) Field of Classification Search
CPC ..... F01L 1/352; F01L 2001/3521; F01L 1/46; F01L 2013/103; F01L 2820/032
USPC ..... 123/90.15
See application file for complete search history.

(56) References Cited

U.S. PATENT DOCUMENTS

2014/0007830 A1* 1/2014 Schaefer ..... F01L 1/352 123/90.17

FOREIGN PATENT DOCUMENTS

| | | | | |
|---|---|---|---|---|
| DE | 102010050814 A1 | 5/2012 | | |
| DE | 102012211526 A1 | 1/2014 | | |
| DE | 102017128423 A1 | 6/2019 | | |
| DE | 102017128731 A1 * | 6/2019 | ..... | F01L 1/352 |
| DE | 102017128731 B4 | 12/2021 | | |
| EP | 2638257 A1 | 9/2013 | | |
| WO | WO-2012062491 A1 * | 5/2012 | ..... | F01L 1/352 |

* cited by examiner

*Primary Examiner* — Jorge L Leon, Jr.

(57) ABSTRACT

The invention relates to a gear device for a motor vehicle, as is used, for example, for adjusting a camshaft in a combustion engine in order to influence the phase angle between crankshaft and camshaft. Such gear devices have to be constructed compactly and also have to have high resistance to wear, in particular upon reaching end stops during adjustment of the phase angle. For this purpose, the gear device has hydraulic end stop damping by the drive unit and the output unit having communicating cavities.

17 Claims, 1 Drawing Sheet

GEAR DEVICE, CAMSHAFT ADJUSTER HAVING THE GEAR DEVICE, AND INTERNAL COMBUSTION ENGINE

CROSS-REFERENCE TO RELATED APPLICATIONS

This application is the U.S. National Phase of PCT Application No. PCT/DE2021/100635 filed on Jul. 22, 2021, which claims priority to DE 10 2020 119 695.4 filed on Jul. 27, 2020, the entire disclosures of which are incorporated by reference herein.

TECHNICAL FIELD

The disclosure relates to a gear device having a drive unit, an output unit and an adjustment unit, wherein the phase position of the output unit relative to the drive unit can be changed by means of the adjustment unit.

BACKGROUND

Gear devices of this type are also referred to as triple-shaft gear mechanisms and are used, for example, in motor vehicles in order to be able to carry out a phase adjustment between the input angular position and the output angular position during operation on rotationally movable units which are driven by a belt or a chain. This is used, for example, to adjust a camshaft in an internal combustion engine in order to adapt the phase angle of the camshaft in relation to the crankshaft to different load conditions or/or speeds of the internal combustion engine and thus increase the performance or the fuel economy of the internal combustion engine or reduce environmental pollution.

For this purpose, these gear devices have electrical adjustment units which, in contrast to hydraulically actuated adjustment units, enable high adjusting speeds within a relatively large temperature window. Such gear devices are particularly efficient when they enable a high transmission ratio as a planetary, eccentric or strain wave gear.

In order to ensure a quick adjustment and still avoid damage caused by a hard impact in the end positions of the angular adjustment, some of these gear devices have damping means on the end stops of the phase adjustment, which dampen the impact in the end positions. These damping elements can be mechanical, but also hydraulic, and are often very difficult to produce or do not offer adequate protection against damage. Other gear units have no protection against a hard end stop.

DE 10 2017 128 423 A1 discloses an electrically actuated gear unit having end stops, which includes a mechanical limitation of the angle of rotation between the output element and the drive element. There is no separate damping of these end stops.

EP 2 638 257 B1 discloses a gear unit for adjusting a camshaft with hydraulic impact damping. When an end position is reached, oil within a cavity between the drive element and the output element can only flow off in a throttled manner via a radially introduced channel in the output element and thus dampens the end stop. The disadvantage here is that the manufacture is complex due to the radially introduced channel and, in addition, due to the selected geometries, damping cannot be easily adapted to the various operating states of the gear unit. A further camshaft adjuster is disclosed in DE 10 2012 211 526 A1.

DE 10 2017 128 731 A1 discloses in FIG. 2*a* camshaft adjuster with a drive unit and an output unit and damped end stops. For this purpose, cavities are formed in front of the end stops. These are connected via bores in the end faces of the end stops to channels that can be filled with oil from a reservoir located radially on the inside. The oil can flow out via oil throttles arranged radially on the outside. The disadvantage of this end stop damping is that, on the one hand, oil has to be pumped constantly, which demands the performance of the oil pump. Furthermore, it is not only necessary to adjust in the vicinity of the end stop, but permanently against the oil pressure, which reduces the response behavior and the adjustment speed. In addition, the manufacture of the essentially radially running oil channels is complex, and the stability of the end stops is reduced due to the introduced holes.

SUMMARY

The object of the disclosure is to improve the prior art.

This object is achieved by a gear device according to that which is described herein. This structure makes it possible to design the hydraulic stop damping of the end stops within the gear device in a compact manner and with a direct connection between the respective first cavity and the respective second cavity, as a result of which effective stop damping is implemented and damage to the drive unit or the output unit is avoided. This ensures that the damping only starts in the area of the end stops, because a narrowing of the cross-section only occurs in the phase positions at the end stops or just before the end stops. Without the narrowing of the cross-section, the hydraulic medium can flow relatively unhindered from one cavity into the other, so that the adjustment performance in the center area is not affected, or is only affected to an insignificant extent. In the area of the narrowing of the cross-section, the hydraulic medium can no longer flow off quickly enough, so that the damping is implemented as a result.

In one embodiment of the disclosure, it can be provided that the overflow path is not completely closed in any phase position. This effectively reduces the stop load to a relatively low value in most operating situations without excessive delay in reaching the end stop. The adjustment performance is therefore also satisfactory in the end stop area.

In another embodiment of the disclosure, the overflow path at the end stop is not only partially but completely closed. The overflow path can also be closed before the end stop is reached. This can ensure that a mechanical impact is always prevented even at high adjustment speeds. In these cases, the end stop can only be adjusted via leakage losses. However, it may also be desirable to always provide an oil cushion between the drive unit and the output unit.

The narrowing of the cross-section can be formed by the lateral surfaces of the drive unit and the output unit in specific angular positions. An active mechanism such as an actuator is therefore not necessary if the narrowing of the cross-section during the phase position change is realized solely through the geometry of the components. The overflow path therefore does not need to be manufactured separately, but is obtained off-tool during component manufacture.

The overflow path can be implemented particularly easily if it is formed at the interface between the drive component and the output component. For this purpose, it can run essentially in the circumferential direction of the gear unit. Radial bores, which serve as oil channels, are therefore no longer required. The integration of the cavities in the surfaces of the drive and output unit saves space and does not require any additional components. For example, the drive unit can be sintered and the cavities can be formed via a sintering process tool.

In the case of a radial output from the overflow path, the end stops do not need to be machined, so that the risk of edge breakage is minimized and the entire geometric cross-sectional area is available as a stop surface.

The following terms are explained here:

A "gear device" can be any arrangement of means for transmitting or transfer mostly rotational effects from a drive side to an output side with or without increasing or reducing the speed, phase position or transferred torque. In particular, this can be a gear device for adjusting a camshaft of an internal combustion engine, which can adjust the phase angle between the drive side and the output side during rotation. The gear device can be designed as a strain wave gear.

For example, a "drive unit" can be any part of a gear device that absorbs an incoming torque or an incoming speed on the drive side and transmits it to the gear device. For this purpose, the drive unit can be designed as a ring gear.

An element referred to as an "output unit" can be any part of a gear device which can output the torque transmitted or converted by the gear device or a correspondingly transmitted or converted speed to other means or components on an output side. This delivery can then take place, for example, from the output unit through a mechanical connection to the camshaft of an internal combustion engine. A compact design is made possible when the output unit is arranged radially inside the drive unit.

An "adjustment unit" can be any mechanical, electrical, hydraulic or other unit that enables or executes an adjustment between the drive unit and the output unit automatically or through external influence or external control. In this case, the adjustment unit can in particular act to the effect that the relative angle between the drive unit and the output unit around the common axis of rotation is changed or adjusted.

The "phase position", also referred to as the adjustment angle, is the relative angle between the drive unit and the output unit in the direction of rotation around the common axis of rotation in relation to a defined reference point. In particular, the phase position describes this relative angle when the drive unit and the output unit rotate together about the common axis, so that the relative angle forms the angle of rotation between the drive unit and the output unit.

For example, any mechanical pairing can be a "sleeve bearing" in which two relatively moving, non-rolling parts are in either direct contact or indirect contact through a lubricant located between the moving parts. As a rotary plain bearing, this can be any pairing of an outer part and an inner part that allows rotation between the outer part and inner part with as little friction as possible.

A "stop element" can be any means that mechanically limits the movement of two components relative to one another. In particular, these are cams, detents, projections and corresponding recesses shaped to match, as well as any other means that fulfills this function. These stop elements act in particular in the rotational direction and thereby limit the maximum possible adjustment angle of the components provided with the stop elements. One or more stop elements can be effectively arranged in each adjustment direction.

Partial ring sections of the drive element or the output element are referred to as "lateral surface segments". In the present case, this can be, for example, a sequence of stop elements and corresponding projections and recesses within a rotationally symmetrical sequence.

"Hydraulic means" may be any such means which, by means of a hydraulic medium, i.e., an incompressible or nearly incompressible fluid, initiates a mechanical function, performs a step-down or transmission of mechanical forces. The hydraulic medium can be, for example, an oil, engine oil or lubricating oil or also water with or without additives. In particular, the hydraulic medium for operating the hydraulic means can be the engine oil of an internal combustion engine in which the gear device is used.

A "stop damping" describes in particular any damping of a mechanical movement when approaching or reaching a mechanical limit or an end position of a possible movement of two components to each other. This can be done linearly or rotationally. In particular, this serves to reduce peak forces when the drive unit and output unit reach an end position after their relative angle to each other about a common axis of rotation has changed. Each stop element can be damped.

Said "cavity" can be any cavity formed between two or more components. This can also be a cavity that is not exclusively formed by two components and in which, for example, a hydraulic medium can flow in and out or remain in the cavity temporarily or permanently. In particular, cavities are formed by segments of the drive unit and the output unit, namely by their interlocking. Such a cavity can be closed off by additional components or can only be completely enclosed by these additional components.

The gear device can have cavities in pairs, so that they can act in any adjustment direction. In an example embodiment, two cavities communicate with one another in each case. This means that the second cavity receives the hydraulic medium displaced from the first cavity and vice versa. In one embodiment, a plurality of first cavities and a plurality of second cavities are provided, between which the hydraulic means can only communicate in pairs. In another embodiment, the multiple first or multiple second cavities are also connected to one another.

An "overflow path" can be any indentation or bore or channel-like milling or otherwise created indentation through which the hydraulic medium can flow. An overflow path can be formed between two cavities, in particular adjacent cavities, and enables the hydraulic medium to flow from one cavity to the other cavity. Such an overflow path, together with a plurality of cavities, can form a hydraulic means as described above. The overflow path can also be formed by the geometric arrangement of the drive unit and the output unit. Advantageously, the overflow path then does not have to be produced by material processing, but forms a narrowing locally through the two components.

In particular, a "direct connection" within the meaning of this application is the connection of an overflow path realized via the shortest possible or even direct path such that the lowest possible flow resistance and/or the smallest possible flow path or, in addition, a simplification of the production of this overflow path is achieved.

In one embodiment, the overflow path is introduced into a side surface of the output unit or the drive unit pointing in the axial direction of the gear unit.

This configuration makes it possible to simplify the manufacture of the drive unit or the output unit in such a way that the overflow path can be introduced into the side surface of the drive unit or the output unit, for example by means of milling. Furthermore, it is possible, for example in the production of the drive unit and/or the output unit in the sinter metallurgical process, to design the tools required for this in such a way that the workpiece remains demoldable from the tool despite the overflow path or paths being molded in.

In order to ensure a particularly low-resistance and easily meterable mode of action of the hydraulic means and to additionally simplify production, the overflow path is arranged essentially in the circumferential direction of the gear unit between one of the first cavities and one of the second cavities.

In a further embodiment, the overflow path is formed until an end position of the angle limitation or both end positions of the angle limitation are reached, so that impact damping is implemented. The overflow path can be formed, for example, as a radial projection of the drive or output unit, which is closed by the drive component and the output component itself during adjustment to the end area of the possible adjustment path, so that effective hydraulic damping only takes place immediately before the end position is reached.

This configuration makes it possible to design the hydraulic means in such a way that a reservoir or cushion is created within at least one cavity before the end position is reached from hydraulic medium, which allows the gear device to be operated in a manner that is gentle on the material in such a way that the stop elements are reliably prevented from striking one another.

In order to prevent the stop elements from hitting one another in a particularly reliable manner and still achieve smooth working behavior of the gear device when the phase position changes, it has proven to be advantageous for the overflow path in a radial coordinate system about an axis of rotation of the gear device to be 1° to 10°, in particular 3° or 5° before reaching an end position or both end positions.

In a further embodiment, an input side of the overflow path arranged in a rotational effective direction has a different cross-section than an output side of the overflow path arranged away from the rotational effective direction of the gear device.

A "rotational effective direction" is a reference direction in polar coordinates for the definition of the input side and output side of the hydraulic means and the overflow path, whereby this rotational direction of action is, for example, the direction of rotation for the phase adjustment of the drive unit and the output unit, in which an adjustment of the phase position to a positive direction of rotation takes place. However, it can also be defined in the opposite direction if this makes sense for the description of the function of the gear device.

An "input side" is the end area of the overflow path in which the hydraulic medium flows from one cavity into another cavity of the hydraulic medium during the execution of the intended function of the gear device.

An "output side" is the end area of the overflow path from which the hydraulic medium flows out from one cavity into another cavity of the hydraulic medium when the intended function of the gear device is carried out.

In order to seal the hydraulic means against the escape of hydraulic medium, in particular oil, and to ensure that no hydraulic medium escapes in such a way that the gear device malfunctions, a sealing element or several sealing elements are provided for the axial sealing of the drive unit and the output unit against each other.

A "sealing element" can be any means that effectively seals against the passage of oil or another hydraulic medium through a desired sealing plane and thereby completely or almost completely holds back the hydraulic medium.

In a further embodiment, the sealing element or the sealing elements is or are an axially acting O-ring or an axially acting X-ring. By using an O-ring or an X-ring, a cheap and proven sealing system can be created, which holds back the hydraulic medium safely and reliably as described above. The function of the gear device is thus reliably ensured.

The sealing system can also be designed in such a way that it seals completely when the angle of rotation changes away from the end stops and only when the end stops are approached, which leads to a minimum oil pressure being exceeded, a controlled pressure reduction takes place via the sealing system.

In a further aspect, the object is achieved by an electric camshaft adjuster having a gear device according to any one of the previous embodiments. This can have a hydraulic means that is independent of the engine oil circuit. Alternatively, the engine oil can be used to realize end stop damping and to cool the camshaft adjuster in a dual function.

In a further aspect, the object is achieved by an internal combustion engine having a camshaft adjuster, which comprises a gear device of the previous embodiments. In internal combustion engines, the gear device can also be used to adjust the compression ratio. Its use is not limited to the vehicle sector; for example, engine applications, steering or trailer stabilization, but can also be used in robots or other devices that utilize a highly compact design.

BRIEF DESCRIPTION OF THE DRAWINGS

The disclosure is explained below using exemplary embodiments. In the figures.

DETAILED DESCRIPTION

Figure 1A:
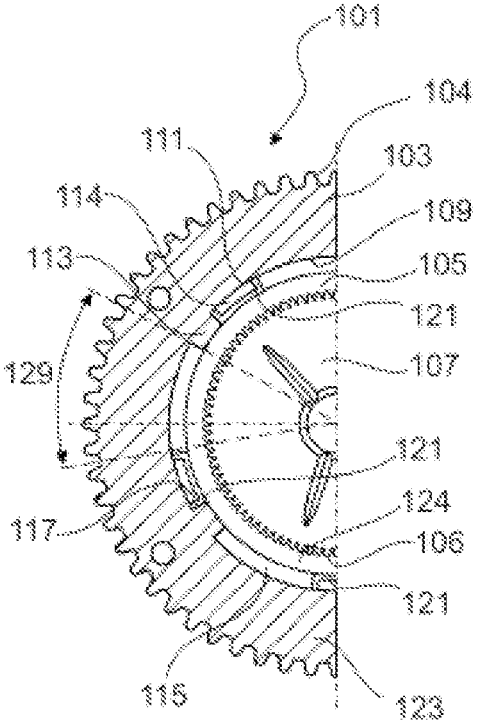
FIG. 1*a* shows a side view of a schematic representation of a left half of a gear device according to the disclosure.
Figure 2A:
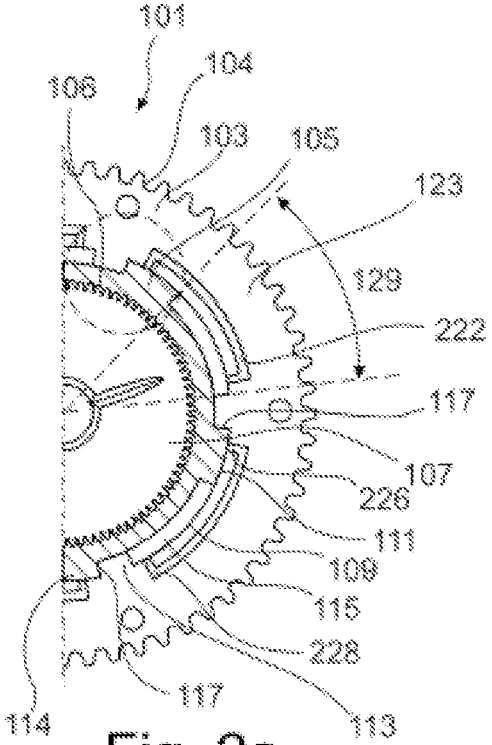
FIG. 2*a* shows a side view of a schematic representation of a right half of a gear device according to the disclosure.
Figure 1B:
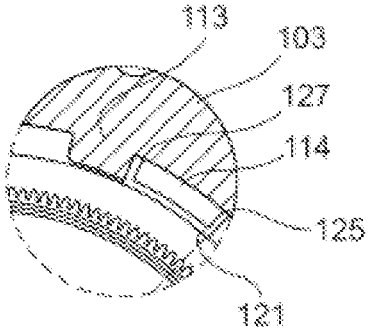
FIG. 1*b* shows a detailed view of the gear device from FIG. 1*a* from a right half of the gear device that is not shown in FIG. 1*a*.
Figure 2B:
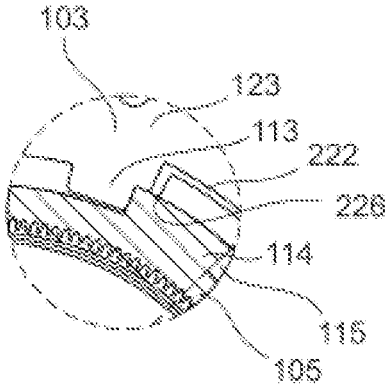
FIG. 2*b* shows a detailed view of the gear device from FIG. 2*a*.

A strain wave gear is designed as a gear device 101 for adjusting a camshaft (not shown) and has a drive unit in the form of a drive wheel 103 and an output unit in the form of an output wheel 105, which are arranged one inside the other with the same axis of rotation.

The drive wheel 103 has an external toothing 104, which serves to accommodate a toothed belt (not shown). The gear device 101 in an internal combustion engine can be driven by means of this toothed belt. For this purpose, the toothed belt is connected to the crankshaft of the internal combustion engine and transmitted in such a way that the drive wheel 103 is driven at half the crankshaft speed.

The output wheel 105 has an internal toothing 106 in which an adjustment unit 107 engages and is thus connected to the output wheel 105. Furthermore, the output wheel 105 is connected in a torque-proof manner to the camshaft of the internal combustion engine, so that the camshaft rotates, depending on the engine speed, together with the gear device 101 at half the crankshaft speed.

In the example shown, the adjustment unit 107 is a strain wave gear, but this is not detailed. The adjustment unit 107 influences a phase adjustment angle 129, which is defined about the common axis of rotation of the drive wheel 103 and the output wheel 105 and describes the rotation of the drive wheel 103 against the output wheel 105 about this axis.

By adjusting the phase adjustment angle 129, the phase angle of the camshaft in relation to the crankshaft can now be adjusted within specified limits while the internal combustion engine is running with the transmission ratio between the crankshaft and the gear device 101 remaining the same and thus also a linearly dependent speed of the camshaft in relation to the crankshaft.

A plain bearing is formed between an inner lateral surface 109 of the drive wheel 103 and an outer lateral surface 111 of the output wheel 105, which enables the output wheel 105 to rotate without issues within the drive wheel 103.

Stop cams 113 are formed within the drive wheel 103 on the inner lateral surface 109 and stop cams 114 are formed in the area of the outer lateral surface 111 of the output wheel 105, which are applied at regular intervals along the respective circumference and thus form a segmentation which interlocks between the drive wheel 103 and the output wheel 105.

The phase adjustment angle 129 is mechanically limited by means of this segmentation by the stop cams 113 and the stop cams 114. The representation shows a left end position of the output wheel 105 within the drive wheel 103. The output wheel 105 can be rotated within the drive wheel 103 through the full phase adjustment angle 129 between two adjacent stop cams 113.

Cavities are formed between the stop cams 113 within the segmentation of the drive wheel 103 and are separated from one another by the stop cams 114 of the output wheel. First cavities 115 and second cavities 117 each form a hydraulic active unit having a stop cam 114, which is filled with the engine oil of the internal combustion engine as the hydraulic medium.

The gear device is sealed laterally against the escape of oil, i.e., from the direction of the side surfaces 123 and 124 and from a side facing away (not shown) by means of further components. These components can be cover discs, for example, or components of the adjustment unit 107. Sealing against the escape of oil then takes place by means of O-rings arranged between these components and the side surfaces 123 and 124.

For the functional description of two configurations below, it should be mentioned that in the operating state shown, the first cavity 115 is enlarged to its full extent and the second cavity 117 is reduced to a size close to zero by reaching the respective end stop between the stop cam 113 and the stop cam 114. At this point, only a minimal oil film remains between the stop cam 113 and the stop cam 114, which cannot be represented.

In a first embodiment, a channel 121 or overflow path is introduced within the stop cam 114 in the output wheel 105. This channel 121 is formed as a depression from a side surface 124 of the output wheel 105 and can therefore be easily produced by means of milling or in a sinter metallurgical process. In the present case, the drive wheel 103 and the output wheel 105 have been produced in such a sinter metallurgical process.

A respective input side 125 and a respective output side 127 of the channels 121 are designed differently in such a way that the channels 121 have a larger cross-section on the input side 125 than on the output side 127.

The input side 125 and the output side 127 are arranged in such a way that a respective first cavity 115 and a respective second cavity 117 can be completely freed of oil through the respective channel 121 when a correspondingly assigned end stop of the output wheel 105 within the drive wheel 103 is reached.

If a phase adjustment between the drive wheel 103 and the output wheel 105 is now carried out by means of the adjustment unit 107, this must take place as uniformly and quickly as possible for smooth engine operation of the internal combustion engine and for a consistently high power output. On the other hand, too rapid an adjustment with the stop cams 114 hitting the stop cams 113 leads to high wear or even breakage of the stop cams 113 or 114 with the destruction of the functionality of the strain wave gear 101.

The function between a first cavity 115 and a second cavity 117 within an active unit is described. Of course, this description can be used for any active unit made up of first cavities 115 and second cavities 117. In total, the functional behavior of the strain wave gear then results from the superimposed function of a plurality of active units.

The oil, which is enclosed in the first cavity 115, prevents rotation of the output wheel 105 relative to the drive wheel 103 by means of the stop cam 114. If a rotation is now initiated by means of the adjustment unit 107, the oil must flow through the channel 121 in the stop cam 114 and experiences increased resistance here. The size of this resistance is influenced by the cross-section of the input side 125, the cross-section of the output side 127 and the cross-section of the channel 121 itself.

If the output wheel 105 now reaches its end stop within the drive gear 103, the rest of the oil that is still present in a cavity 115 or 117 between the stop cam 114 and the stop cam 113 in the thickness direction of the strain wave gear is pressed out of this cavity. As a result of this process, when the end stop is reached, the adjustment process is dampened so that a damage to the strain wave gear 101 is reliably avoided.

In a second (alternative) embodiment of a strain wave gear 101, a channel 222 or overflow path is introduced within the side surface 123 in the drive wheel 103. This channel is formed as a depression from the side surface 123 of the drive wheel 103 and can therefore be easily produced by means of milling or in a sinter metallurgical process. In the present case, the drive wheel 103 and the output wheel 105 have been produced in such a sinter metallurgical process.

A respective input side 226 and a respective output side 228 of the channels 222 are designed differently in such a way that the channels 222 have a larger cross-section on the input side 226 than on the output side 228.

The input side 226 and the output side 228 are arranged in such a way that a respective first cavity 115 and a respective second cavity 117 can be completely freed of oil through the respective channel 222 when a correspondingly associated end stop of the output wheel 105 within the input wheel 103 is reached up to an angle of about 3° in the direction of rotation before reaching the final end stop because the oil can flow freely between the cavities through the channel 222. For the remaining 3°, an oil cushion forms in the remaining cavity 117, which additionally dampens the end stop.

If a phase adjustment between the drive wheel 103 and the output wheel 105 is now carried out by means of the adjustment unit 107, this must take place as uniformly and quickly as possible for smooth engine operation of the internal combustion engine and for a consistently high power output. On the other hand, too rapid an adjustment with the stop cams 114 hitting the stop cams 113 leads to high wear or even breakage of the stop cams 113 or 114 with the destruction of the functionality of the strain wave gear 101.

Again, the function between a first cavity 115 and a second cavity 117 within an active unit is described. Of course, this description can also be used for the second embodiment for each active unit made up of first cavities 115 and second cavities 117. In total, the functional behavior of the strain wave gear then results from the superimposed function of a plurality of active units.

The oil, which is enclosed in the first cavity 115, prevents rotation of the output wheel 105 relative to the drive wheel 103 by means of the stop cam 114. If a rotation is now initiated by means of the adjustment unit 107, the oil must flow through the channel 222 in the side surface 123 and experiences increased resistance here. The magnitude of this resistance is influenced by the cross-section of the input side 226, the cross-section of the output side 228 and the cross-section of the channel 222 itself.

If the output wheel 105 now reaches a position of approx. 3° before its mechanical end stop within the drive wheel 103, then the rest of the oil which is still present in the thickness direction of the strain wave gear 101 between the stop cam 113 and the stop cam 114 in a cavity 115 or 117 is not immediately pressed out of this cavity by the position of the input side 226 or the output side 228, depending on the direction of rotation, but remains as a cushion-like residual quantity initially in the corresponding cavity 115, 117. As a result of this process, the adjustment process is dampened before the end stop is reached, which means that damage to the strain wave gear 101 is avoided even more reliably and for more extreme operating states or incorrect activations, and softer adjustment behavior for the camshaft is also achieved.

LIST OF REFERENCE SYMBOLS

101 Gear device, strain wave gear
103 Drive unit, drive wheel
104 Outer toothing
105 Output unit, output wheel
106 Inner toothing
107 Adjustment unit
109 Inner lateral surface
111 Outer lateral surface
113 First stop element
114 Second stop element
115 First cavity
117 Second cavity
121 Overflow path, channel
123 Side face
124 Side face
125 Input side
127 Output side
129 Phase adjustment angle
222 Overflow path, channel
226 Input side
228 Output side
229 Phase adjustment angle

The invention claimed is:

1. A gear device for an electric camshaft adjuster, the gear device comprising:
a drive unit,
an output unit disposed radially inside of the drive unit,
an electric adjustment unit configured to adjust a phase position of the output unit in relation to the drive unit,
a rotary plain bearing defined by an inner peripheral surface of the drive unit and an outer peripheral surface of the output unit,
a first projection and a second projection arranged on the drive unit so as to extend radially inward,
a third projection arranged on the output unit so as to extend radially outward between the first projection and the second projection,
a first cavity defined by the drive unit and the output unit between the first projection and the third projection,
a second cavity defined by the drive unit and the output unit between the second projection and the third projection, and
an overflow path connecting the first cavity to the second cavity,
wherein the overflow path is formed on the drive unit between the first projection and the second projection, or the overflow path extends across the third projection,
wherein the output unit is configured to rotate in relation to the drive unit between (i) a first end stop phase position in which the third projection contacts the first projection in a first rotational direction, and (ii) a second end stop phase position in a second rotational direction, and
wherein the overflow path is configured to enable hydraulic fluid to flow from the first cavity to the second cavity so as to dampen an impact between the drive unit and the output unit when the electric adjustment unit adjusts the phase position to the first end stop phase position.

2. The gear device according to claim 1, wherein a cross-sectional area of the overflow path is narrowed when the first end stop phase position is reached.

3. The gear device according to claim 2, wherein the cross-sectional area of the overflow path is narrowed via one of the inner or outer peripheral surfaces.

4. The gear device according to claim 1, wherein the overflow path is closed before the first end stop phase position is reached.

5. The gear device according to claim 1, wherein a cross-sectional area of a first end of the overflow path is different from a cross-sectional area of a second end of the overflow path.

6. The gear device according to claim 1, wherein the overflow path is formed via a sintering process.

7. The gear device according to claim 1, further comprising one or more sealing elements configured to seal the first and second cavities.

8. An internal combustion engine comprising the gear device for the electric camshaft adjuster according to claim 1, wherein the hydraulic fluid is engine oil of the internal combustion engine.

9. The gear device according to claim 1, wherein the gear device is a strain wave gear.

10. The gear device according to claim 9, wherein the drive unit is a ring gear.

11. An electric camshaft adjuster, comprising:
a strain wave gear device including:
a ring gear,
an output unit disposed radially inside of the ring gear,
an electric adjustment unit configured to adjust a rotary position of the output unit relative to the ring gear,
a rotary plain bearing defined by an inner peripheral surface of the ring gear and an outer peripheral surface of the output unit,
a first projection and a second projection arranged on the ring gear so as to extend radially inward, a third projection arranged on the output unit so as to extend radially outward between the first projection and the second projection, a first cavity defined by the ring gear and the output unit between the first projection and the third projection, a second cavity defined by the ring gear and the output unit between the second projection and the third projection, and a depression defining an overflow path formed on the ring gear between the first projection and the second projection so as to connect the first cavity to the second cavity, wherein the output unit is configured to rotate in relation to the ring gear between (i) a first end stop phase position in which the third projection contacts the first projection in a first rotational direction, and (ii) a second end stop phase position in a second rotational direction, and wherein the depression is configured to enable a flow of fluid from the first cavity to the second cavity so as to dampen an impact between the ring gear and the output unit when the electric adjustment unit adjusts the phase position to the first end stop phase position.

12. The electric camshaft adjuster according to claim 11, wherein the depression extends circumferentially on the ring gear.

13. The electric camshaft adjuster according to claim 11, wherein the overflow path is closed before the first end stop phase position is reached by the third projection.

14. The electric camshaft adjuster according to claim 11, wherein the depression is formed via a sintering process of the ring gear.

15. The electric camshaft adjuster according to claim 11, wherein the depression is formed on an axial surface of the ring gear.

16. An electric camshaft adjuster, comprising:

a strain wave gear device including:

a ring gear, an output unit disposed radially inside of the ring gear, an electric adjustment unit configured to adjust a rotary position of the output unit relative to the ring gear, a rotary plain bearing defined by an inner peripheral surface of the ring gear and an outer peripheral surface of the output unit, a first projection and a second projection arranged on the ring gear so as to extend radially inward, a third projection arranged on the output unit so as to extend radially outward between the first projection and the second projection, a first cavity defined by the ring gear and the output unit between the first projection and the third projection, a second cavity defined by the ring gear and the output unit between the second projection and the third projection, and a depression defining an overflow path extending across the third projection so as to connect the first cavity to the second cavity, wherein the output unit is configured to rotate in relation to the ring gear between (i) a first end stop phase position in which the third projection contacts the first projection in a first rotational direction, and (ii) a second end stop phase position in a second rotational direction, and wherein the depression is configured to enable a flow of fluid from the first cavity to the second cavity so as to dampen an impact between the ring gear and the output unit when the electric adjustment unit adjusts the phase position to the first end stop phase position.

17. The electric camshaft adjuster according to claim 16, wherein the depression is arranged on an axial surface of the output unit.

* * * * *